US008931311B2

(12) United States Patent
Leibman et al.

(10) Patent No.: US 8,931,311 B2
(45) Date of Patent: Jan. 13, 2015

(54) ADDITIVE DISPENSER FOR A WASHING MACHINE

(75) Inventors: Alexander Boris Leibman, Prospect, KY (US); Jerrod Aaron Kappler, Louisville, KY (US); Alaknanda Acharya, Louisville, KY (US)

(73) Assignee: General Electric Company, Schenectady, NY (US)

( * ) Notice: Subject to any disclaimer, the term of this patent is extended or adjusted under 35 U.S.C. 154(b) by 913 days.

(21) Appl. No.: 13/094,267

(22) Filed: Apr. 26, 2011

(65) Prior Publication Data

US 2012/0272691 A1 Nov. 1, 2012

(51) Int. Cl.
*D06F 35/00* (2006.01)
*D06F 39/02* (2006.01)
*D06F 23/04* (2006.01)

(52) U.S. Cl.
CPC ..... *D06F 39/02* (2013.01); *D06F 23/04* (2013.01)
USPC ..... 68/17 R; 68/3 R

(58) Field of Classification Search
CPC ..... D06F 39/02; D06F 23/04
USPC ..... 68/17 R, 3 R; 134/56 D, 57 D, 58 D
See application file for complete search history.

(56) References Cited

U.S. PATENT DOCUMENTS

| | | | | |
|---|---|---|---|---|
| 4,111,011 | A * | 9/1978 | Waugh | 68/17 R |
| 5,235,994 | A * | 8/1993 | Comin et al. | 134/93 |
| 7,181,934 | B2 | 2/2007 | Hsu et al. | |
| 7,337,635 | B2 * | 3/2008 | Cerruti et al. | 68/17 R |
| 2004/0020517 | A1 * | 2/2004 | Cerruti et al. | 134/25.2 |
| 2005/0115595 | A1 * | 6/2005 | Cerruti et al. | 134/93 |
| 2005/0269346 | A1 | 12/2005 | Limback et al. | |
| 2008/0223417 | A1 * | 9/2008 | Cerruti et al. | 134/93 |
| 2009/0095750 | A1 | 4/2009 | Vitan et al. | |
| 2011/0030729 | A1 * | 2/2011 | Gnadinger et al. | 134/18 |

* cited by examiner

*Primary Examiner* — Michael Barr
*Assistant Examiner* — Benjamin L Osterhout
(74) *Attorney, Agent, or Firm* — Dority & Manning, P.A.

(57) ABSTRACT

A washing machine includes a casing, a tub disposed within the casing, and a basket configured for receipt of articles to be washed. An additive pack dispenser is disposed within the casing above the tub and included a pack receiver configured for receipt of an additive pack therein. The receiver is biased to a first position wherein the additive pack is stored and is movable to a second position wherein the additive pack is dispensed by gravity from the receiver into the tub. An actuator is disposed proximate to the receiver and is oriented so as to move the receiver at a defined time to cause the receiver to move to the second dispense position and deposit the additive pack into the tub.

12 Claims, 7 Drawing Sheets

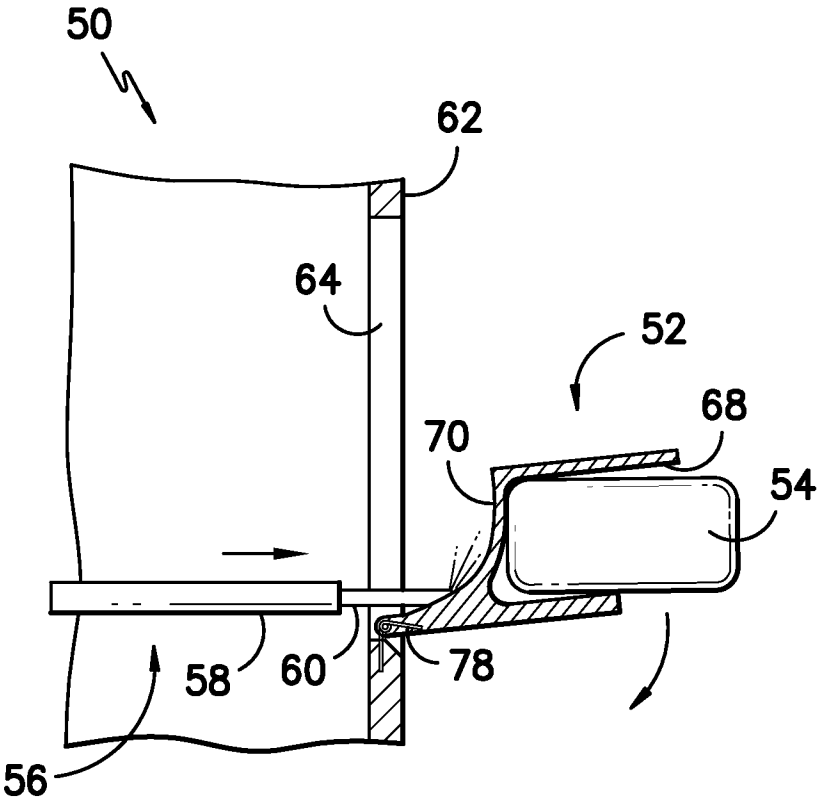
FIG. —3E—
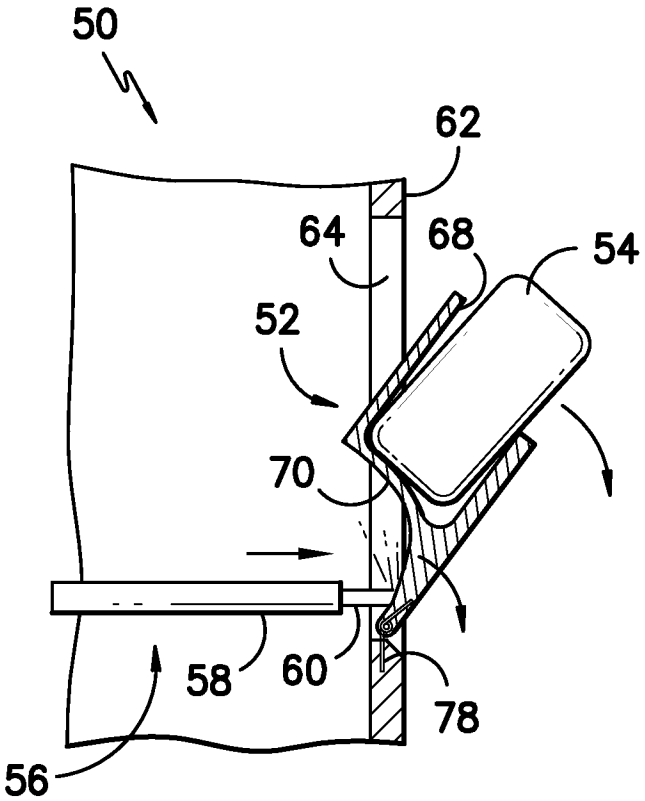
FIG. —3D—

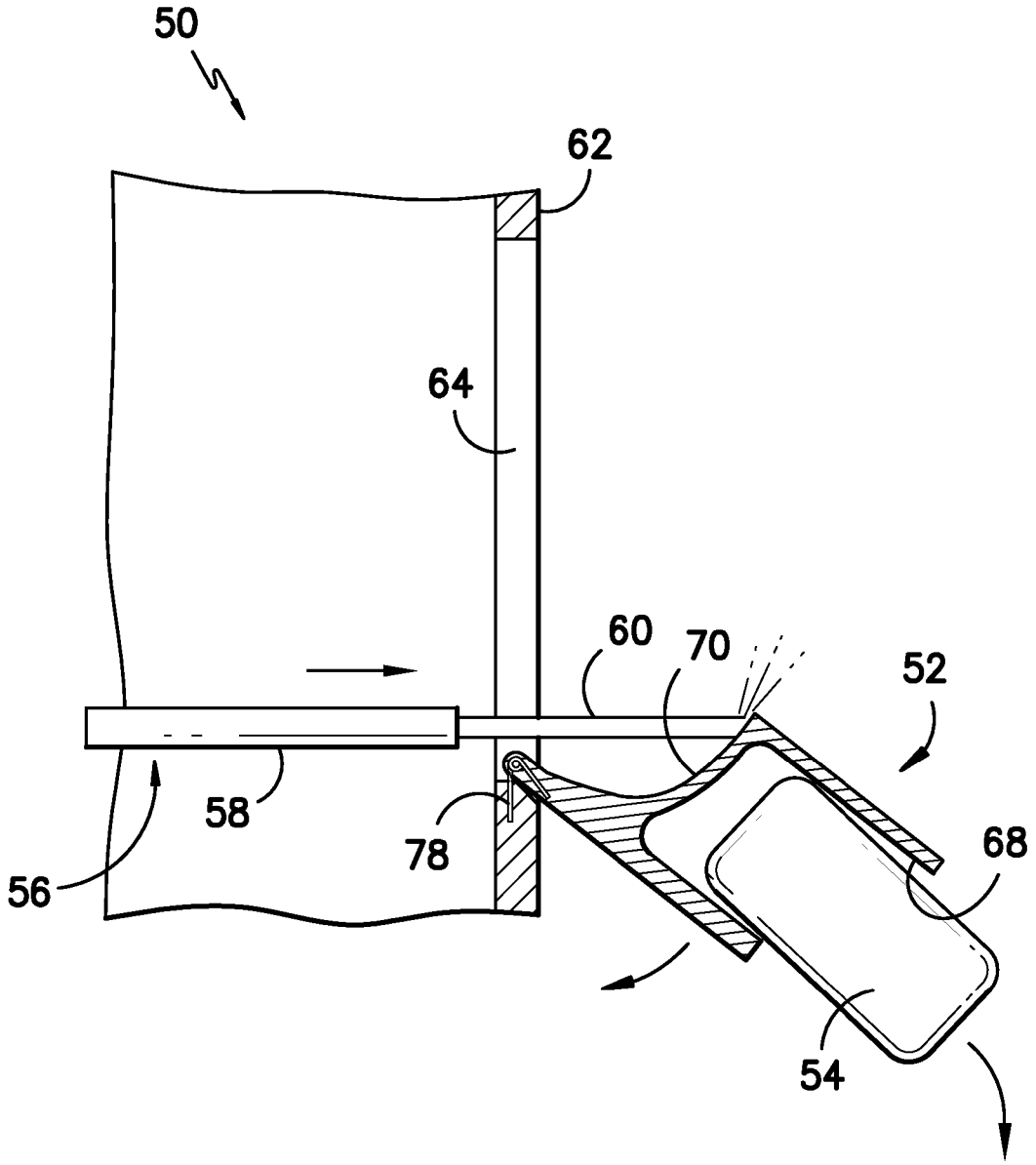
FIG. —3F—

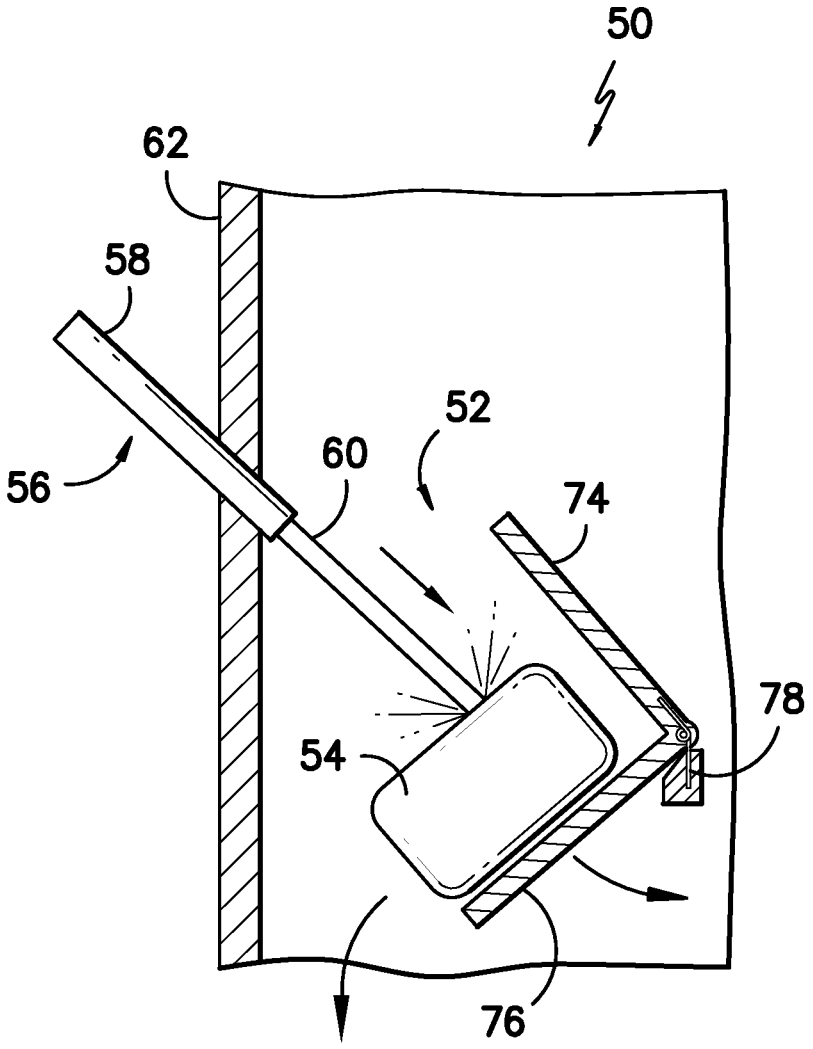
FIG. —4E—

ADDITIVE DISPENSER FOR A WASHING MACHINE

FIELD OF THE INVENTION

The present subject matter relates generally to appliances such as washing machines, and more particularly to an additive dispensing system in a washing machine.

BACKGROUND OF THE INVENTION

Conventional residential washing machines typically include an internal additive storage system that stores a quantity of liquid additive (such as detergent, fabric softener, and so forth) and dispenses the additive at a defined point in the wash cycle. Certain types and brands of additives, however, are supplied to consumers in a pack, pouch, or pack form (referred to generically herein as an "additive pack") and are typically manually dropped into the wash tub by the consumer at the appropriate point in the wash cycle. This practice requires that the consumer monitor the appliance to determine the stages of the wash cycle, and take the effort to actually deposit the additive pack in the machine at the right time, if they remember to do so. Often, the additive pack is not deposited by the consumer despite every intention to do so. Horizontal axis washing machines require pumping out the water before the consumer can open the door to deposit the additive pack, which requires refilling the machine.

Accordingly, it would be desirable to provide a washing machine with an additive pack dispenser apparatus that automatically deposits additives at a defined time in the wash cycle without consumer intervention.

BRIEF DESCRIPTION OF THE INVENTION

Aspects and advantages of the invention will be set forth in part in the following description, or may be obvious from the description, or may be learned through practice of the invention.

In a particular embodiment, a washing appliance, such a consumer washing machine, includes a casing and a tub disposed within the casing. The tub includes a basket configured for receipt of articles to be washed. An additive pack dispenser is operably located within the casing above the tub. The dispenser includes a pack receiver configured for receipt of an additive pack therein. The receiver is biased to a first position wherein the additive pack is stored and is movable to a second position wherein the additive pack is dispensed by gravity from the receiver into the tub. An actuator is disposed proximate to the receiver and is in communication with a fluid source, for example an air or water source. The actuator may include a nozzle that is oriented so as to direct the fluid stream towards the receiver at a pre-defined time to cause the receiver to move to the second dispense position and deposit the additive pack into said tub. Any other type of suitable actuator may be used, for example a piston, motor drive, and the like.

The receiver may be movable to a third position for loading of an additive pack therein. In a particular embodiment, the receiver may be biased to the first position, for example with a torsion spring, and is pivotal at a pivot point to the second and third positions. In an alternate embodiment, the additive pack may be loaded into the receiver at the first position of the receiver.

The receiver may be configured in various ways. In a particular embodiment, the receiver has a receptacle or "cup" section in which the additive pack is stored and an impingement surface located between the cup section and the pivot point. The actuator may be oriented to direct a fluid stream against the impingement surface, causing the receiver to pivot away from the fluid stream to the dispense position. The impingement surface may have an arcuate shape and be oriented so as to be continuously impinged by the fluid stream from the actuator as the receiver moves between the first and second positions.

The dispenser may be variously supported within the casing. For example, the dispenser may be supported on a top wall of the casing above the tub. The dispenser may have a housing that is suspended from the top wall or mounted to a side wall of the housing.

In a particular embodiment, the receiver may have a retaining surface against which the additive pack rests in the first position. The actuator is oriented so as to direct the water stream towards the retaining surface and against the additive pack to pivot the receiver to dispense position. With this embodiment, the additive pack is pre-wetted (or even partially dissolved) before it is deposited into the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIGS. 3A through 3F are sequential operational views of an embodiment of an additive pack dispenser in accordance with aspects of the invention; and FIGS. 4A through 4E are sequential operational views of another embodiment of an additive pack dispenser.

DETAILED DESCRIPTION OF THE INVENTION

Figure 2:
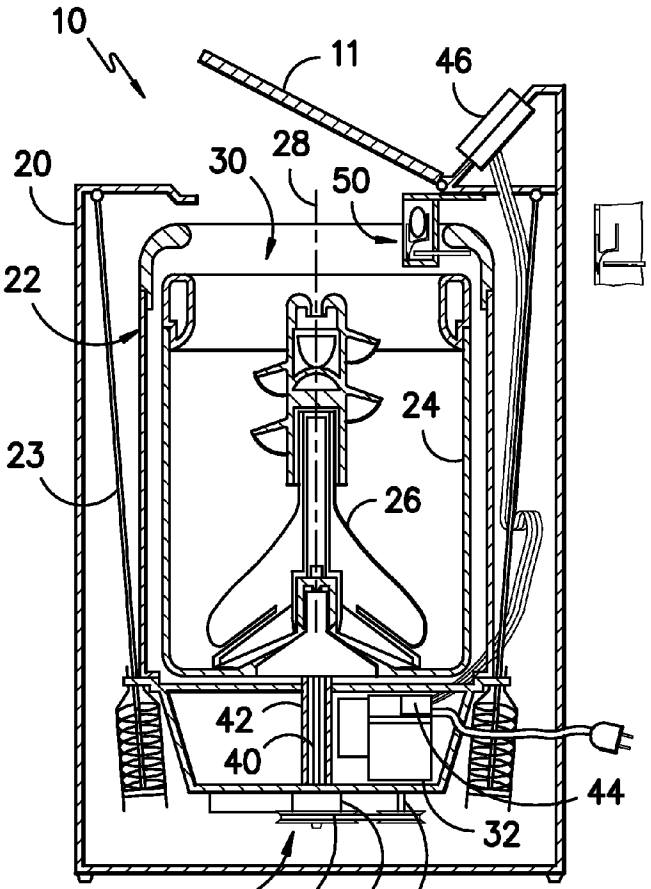
FIG. 2 is a cut-away view of the washing machine of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 1:
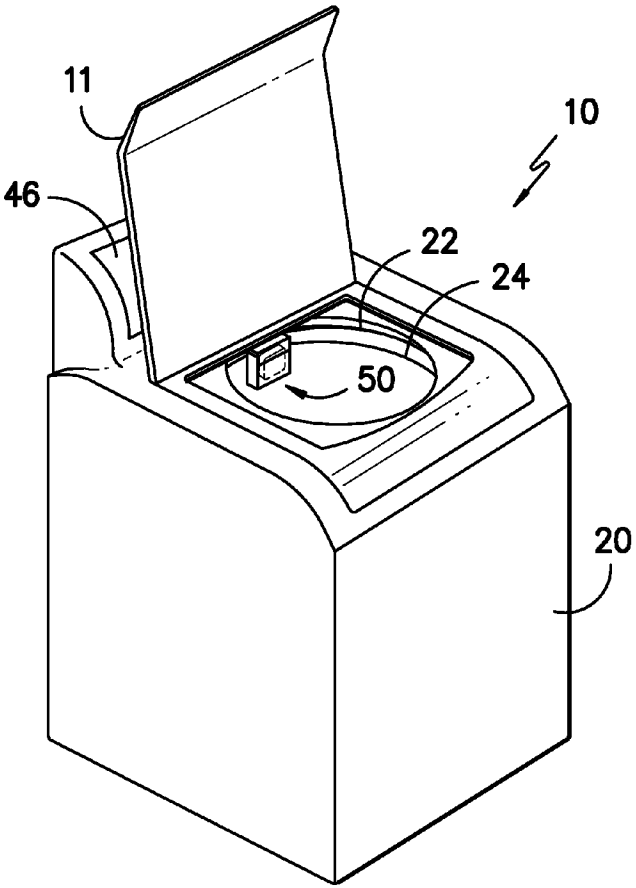
FIG. 1 is a perspective view of an exemplary washing machine with an additive pack dispenser depicted in phantom.

FIGS. 1 and 2 illustrate a conventional washing machine 10 that may be configured in accordance with aspects of the invention and are provided for illustrative purposes only to place the present invention in its working environment. It should be appreciated that the invention is not limited to any particular type or style of washing machine 10. In general, such machines 10 are front loading or top-loading (as in FIG. 1) through a door 11. The machine 10 has an external casing 20 and an internal tub structure 22 suspended with springs 23. A clothes basket 24 and agitator 26 are configured in the drum 22 and revolve about an axis 28. The basket 24 has an open top 30 for receipt of clothes or other articles to be washed. The basket 24 is driven by a motor 32 via a drive arrangement 34, which may include a pulley mounted to a motor driveshaft 36 connected by a belt 38 to a pulley that is mechanically linked to the basket driveshaft 40 and spin tube 42. The driveshaft 40 is directly coupled to the pulley and belt 38, and drives the agitator 26. The spin tube is directly coupled to the basket 24. A clutch 116 locks elements 40 and 42 together during the spin cycle. The motor is controlled by a control unit 44. A control panel 46 is provided for the consumer to operate the machine 10.

FIGS. 1 and 2 illustrate an additive pack dispenser 50 in accordance with aspects of the invention mounted within the washing machine 10 at a location so that, upon actuation, an additive pack is dispensed into the clothes basket 24. In the illustrated embodiment, the pack dispenser 50 is mounted directly or indirectly to the casing 20 towards a rear of the tub 22, for example generally beneath the control panel 46. The dispenser 50 is readily accessible to a user simply by opening the lid 11 and placing any manner of additive pack into the dispenser, as described in greater detail below. It should be appreciated that the dispenser 50 may also be mounted at the front side of the tub 22, or along the sides, with the only requirement being that the dispenser 50 is located and oriented so as to be readily accessible to the user and to deposit the additive pack into the clothes basket 24.

A particular embodiment of the additive pack dispenser 50 is illustrated in the operational views of FIGS. 3A through 3E. In this particular embodiment, a pack receiver 52 is operably configured within a housing structure 62, and moves into and out of the housing structure 62 via an opening 64 within the housing structure 62. The housing structure 62 may, in turn, be mounted to the machine casing 20 by any suitable means. The receiver 52 is configured for receipt of an additive pack 54. The pack 54 may be, for example, a fabric softener, detergent, water treatment chemical, and the like. It should be readily appreciated that the invention is not limited to a particular type or use of additive pack 54. Although depicted as a solid tabular member, it should also be appreciated that the additive pack 54 may be a pouch, pack, or other similar permeable device that contains a granular or other type of solid treatment composition.

Figure 3C:
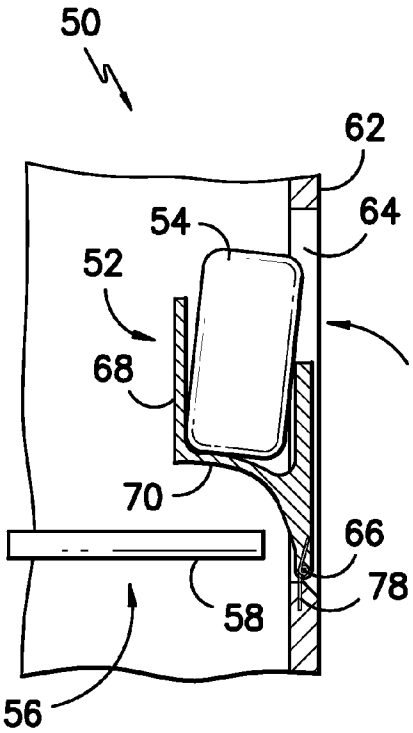
Figure 3B:
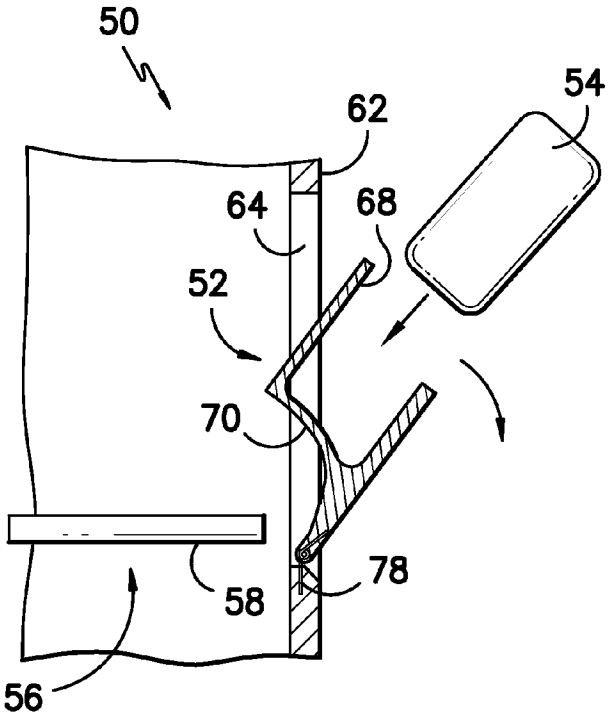
Figure 3A:
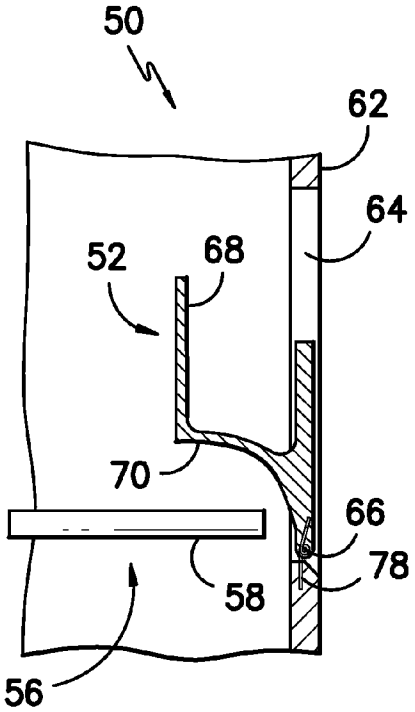

The receiver 52 is biased to a first position illustrated in FIG. 3A wherein the additive pack is stored, and is movable to a second position wherein the additive pack is eventually dispensed into the clothes basket 24, as depicted in FIG. 3F. An actuator 56 is disposed proximate to the dispenser 50 and is oriented so as to engage the receiver 52 at a defined time in the wash cycle to cause the receiver 52 to move to the second dispense position depicted in FIG. 3F to deposit the additive pack 54 into the clothes basket 24.

Referring still to FIGS. 3A through 3F, in a particular embodiment, the receiver 52 defines a cup section 68 configured for receipt of the pack 54. It should be appreciated that this cup section 68 may be defined by any type of structure, and that the particular shape and configuration illustrated in the figures is for illustrative purposes only. The receiver 52 is biased in the illustrated embodiment by a torsion spring 78 mounted at a pivot point 66.

FIG. 3B depicts the receiver 52 being pivoted to a third position for loading of the additive pack 54. For example, a consumer may readily grasp any part of the cup section 68 through the opening 64 and pivot the receiver 52 out of the housing 62, as depicted in FIG. 3B. The consumer places the additive pack 54 into the cup receiver and releases the receiver 52, which returns to the first position depicted in FIG. 3C by action of the spring 78. In an alternative embodiment, the consumer may be able to place the additive pack 54 into the receiver 52 in the first position of the receiver 52.

FIGS. 3B through 3E illustrate operation of a particular type of actuator 56 that causes the receiver 52 to move to the dispense position. In FIG. 3D, the actuator 56 includes a nozzle 58 that is in communication with a fluid source, such as a pressurized water source (e.g., the water line that supplies water to the tub 22 for the wash cycle), a pressurized air source, and the like. Any manner of suitable in-line valve and a conduit that supplies the pressurized water to the nozzle 58 may be utilized to actuate the mechanism at the appropriate time in the wash cycle. In FIG. 3D, the fluid source is a water source and a water stream 60 is emitted from the nozzle 58 and impinges on a curved impingement surface 70 defined under the cup section 68 of the receiver 52. The force of the impinging water causes the receiver 52 to rotate clockwise as depicted in FIG. 3B. The curved nature of the impingement surface 70 ensures that the retainer 52 continues to rotate in the clockwise direction without the necessity of moving the nozzle 58. The receiver 52 continues to rotate through the position depicted in FIG. 3E to the final dispense position depicted in FIG. 3F. The receiver 52 is held in the position in FIG. 3F by the water stream 60 for a sufficient period of time to allow the additive pack 54 to drop into the clothes basket. After the pack 54 is dispensed, the water supply to the nozzle 58 is terminated and the receiver 52 returns to the position illustrated in FIG. 3A under the force of the torsion spring 78.

It should be appreciated that the actuator 56 may vary within the scope and spirit of the invention. For example, instead of using a water stream as depicted in FIGS. 3A through 3F to move the receiver 52 between the various operational positions, the actuator 56 may employ a piston for the same purpose. In other embodiments, a relatively small motor may be used to drive the receiver 52 between the various operational positions. Any manner of suitable actuator may be utilized in this regard.

Figure 4B:
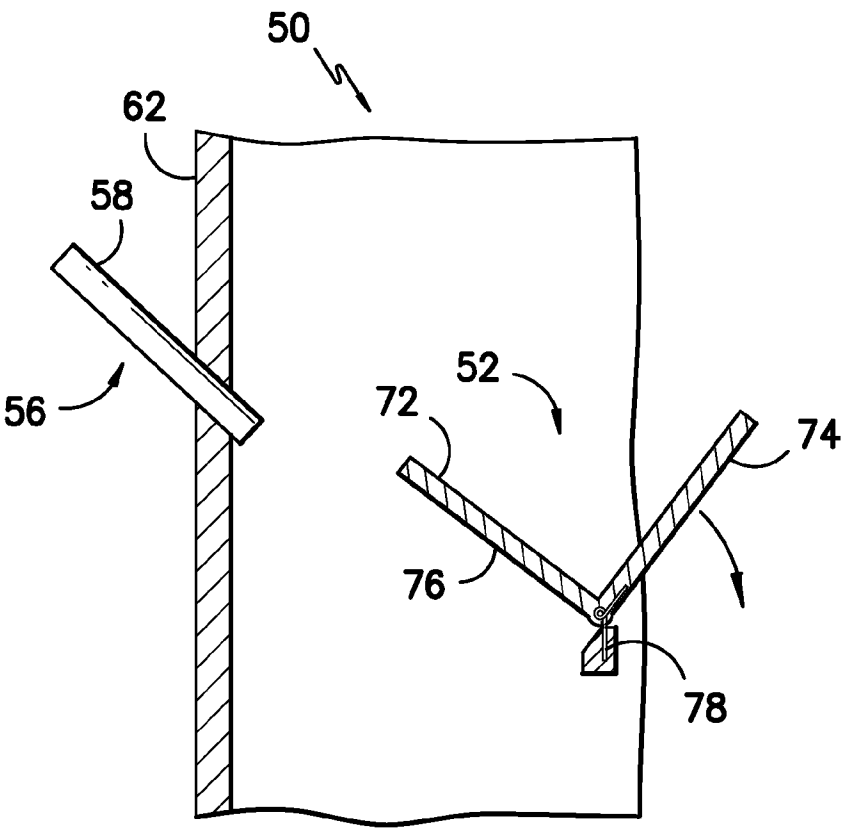
Figure 4A:
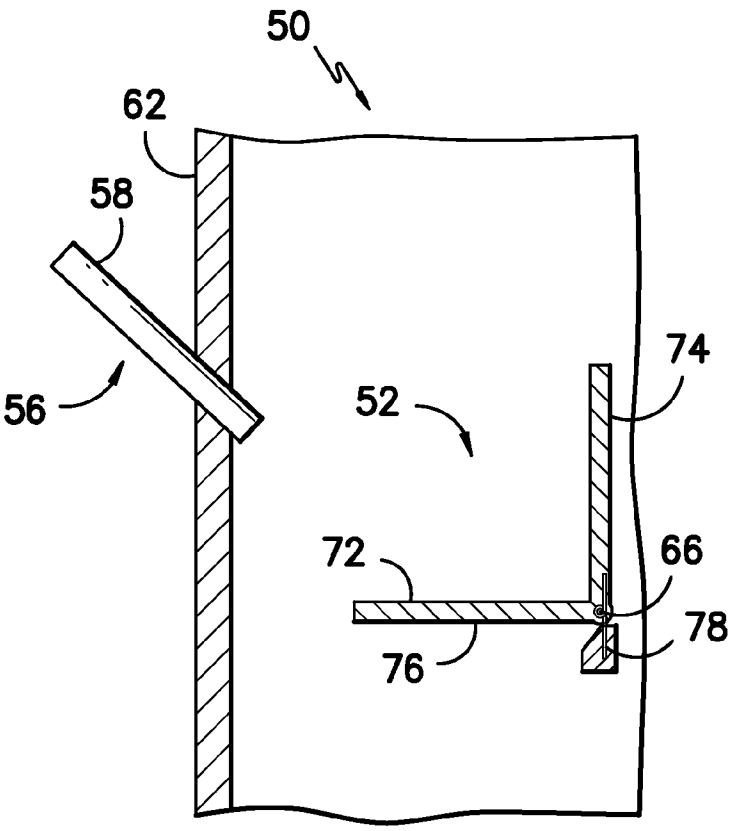
Figure 4D:
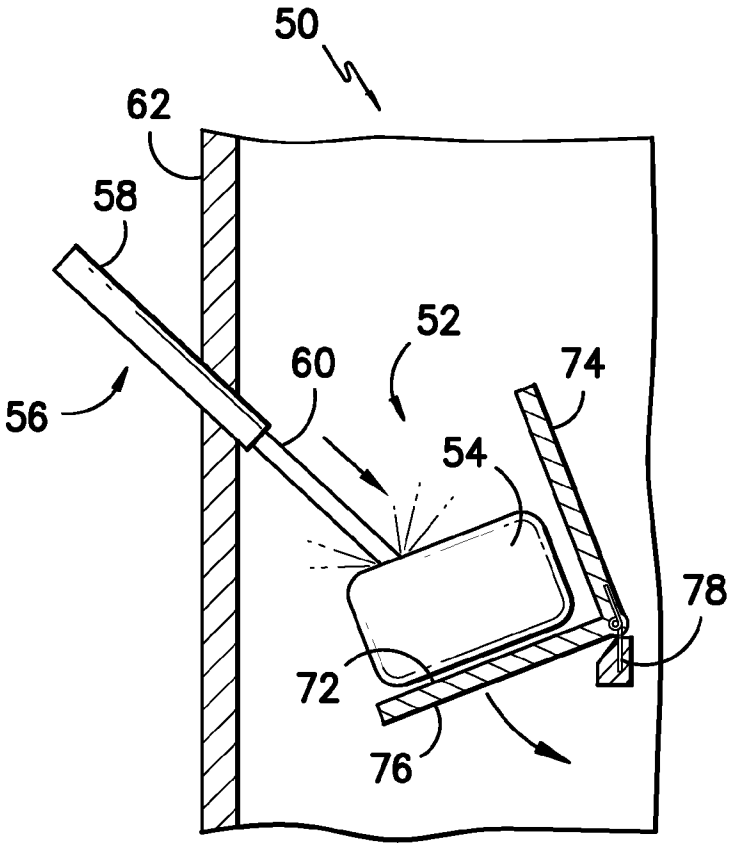
Figure 4C:
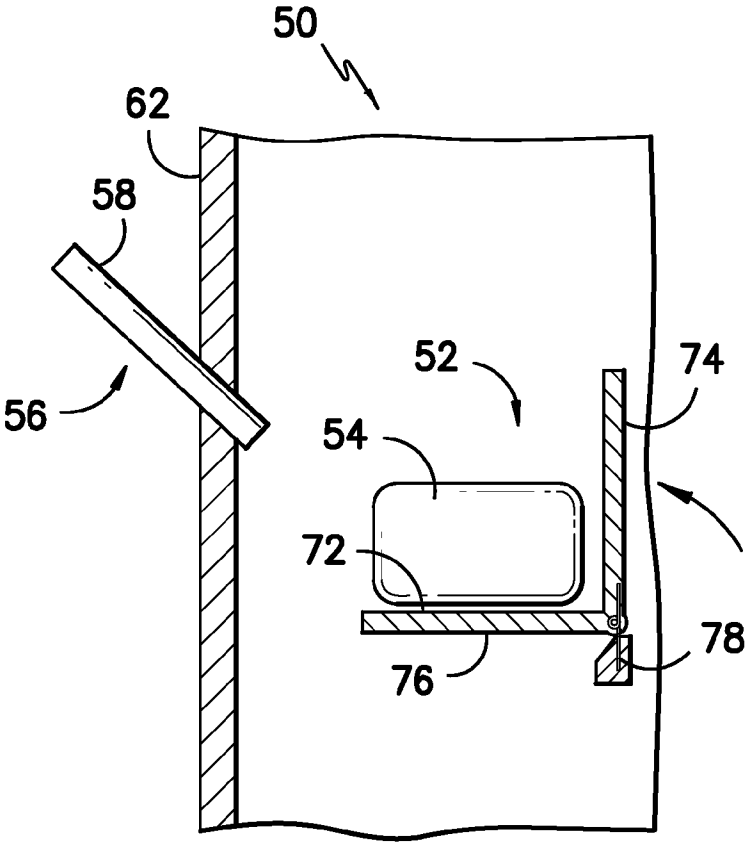

FIGS. 4A through 4E depict an alternative embodiment of an additive pack dispenser 50 that also utilizes a water nozzle 68 as the actuating mechanism 56. In this embodiment, the receiver 52 is pivotally mounted to any suitable part of the housing 62 at a pivot point 66. The receiver 52 is biased to an initial position indicated in FIG. 4A via the torsion spring 78. In this embodiment, the retainer 52 is defined by generally transverse legs 74 and 76, with the horizontal leg 76 defining a retaining surface 72 against which the additive pack 54 is initially disposed, as depicted in FIG. 4C. The legs 74, 76 are depicted in the figures at a generally perpendicular orientation. It should be readily appreciated that any manner of suitable orientation and configuration of the legs 74, 76, or other structure, may be utilized to define a retaining surface 72 for the pack 54 that exposes the pack 54 to the water stream emitted from the nozzle 58.

FIG. 4B depicts the retainer 52 being rotated clockwise to the load position wherein a consumer would simply place the additive pack into the retainer 52 against the retaining surface 72, and allow the retainer 52 to return to the position depicted in FIG. 4C with the pack 54 loaded therein.

Referring to FIG. 4C, the nozzle 58 is oriented towards the exposed pack 54 and, upon actuation of the nozzle 58, a water stream 60 is emitted from the nozzle 58 and impinges directly on the pack 54, as depicted in FIG. 4D. The force of the water stream 60 causes the retainer 52 to rotate in the opposite counter-clockwise direction, as depicted in FIG. 4D, until the retainer 52 rotates to a position that causes the pack 54 to fall by gravity through and open bottom of the housing 62 into the clothes basket 24, as depicted in FIG. 4E. Upon termination of the water stream 60 from the nozzle 58, the retainer 52 will return to its initial position depicted in FIG. 4A.

The embodiment depicted in FIGS. 4A through 4E is beneficial in that the additive pack 54 is pre-wetted by the water stream 60 before the pack is dropped into the clothes basket 24. This reduces the risk that the chemicals in the pack will harm (e.g., discolor) the clothes in the basket 24 prior to being wetted.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, comprising:

a casing;

a tub disposed within said casing, the tub including a basket configured for receipt of articles to be washed; and an additive pack dispenser disposed within said casing above said tab, said dispenser comprising a pack receiver configured for receipt of an additive pack therein, said receiver biased to a first position wherein the additive pack is stored, said receiver movable to a second position wherein the additive pack is dispensed by gravity from said receiver into said rob; and an actuator disposed proximate to said receiver, said actuator oriented so as to move said receiver at a defined time to said second dispense position and deposit the additive pack into said tub;

wherein said actuator is in communication with a fluid source and oriented so as to direct a fluid stream towards said receiver, defining an impingement surface, at the defined time to cause said receiver to move to said second dispense position.

2. The washing appliance as in claim 1, wherein said receiver is movable to a third position for loading of an additive pack therein.

3. The washing appliance as in claim 2, wherein said receiver is biased to said first position and is pivotal at a pivot point to said second and third positions.

4. The washing appliance as in claim 1, wherein said receiver comprises a cup section in which the additive pack is stored and an impingement surface located between said cup section and said pivot point, said actuator oriented so as to direct the water stream against said impingement surface.

5. The washing appliance as in claim 3, wherein said impingement surface is arcuate and oriented so as to be continuously impinged by the water from said actuator as said receiver moves between said first and second positions.

6. The washing appliance as in claim 1, wherein said dispenser is supported on a top wall of said casing above said tub.

7. The washing appliance as in claim 1, wherein said actuator comprises a nozzle oriented towards said receiver.

8. The washing appliance as in claim 1, wherein said receiver is biased to said first position and is pivotal at a pivot point to said second position.

9. The washing appliance as in claim 8, wherein said receiver comprises a retaining surface against which the additive pack rests in said first position, said actuator oriented so as to direct a fluid stream towards said retaining surface and against the additive pack to pivot said receiver to said dispense position.

10. The washing appliance as in claim 1, wherein said dispenser comprises a housing supported on said casing, said receiver movable into and out of said housing for loading the additive pack therein.

11. The washing appliance as in claim 10, wherein said receiver drops the additive pack through an open bottom of said housing in said second dispense position.

12. The washing appliance as in claim 10, wherein said receiver pivots out of said housing to said second dispense position.

* * * * *